US006874175B2

(12) United States Patent
Laflamme et al.

(10) Patent No.: US 6,874,175 B2
(45) Date of Patent: Apr. 5, 2005

(54) CONTROL PANEL AND CONTROL SYSTEM FOR A SPA

(75) Inventors: Benoit Laflamme, Quebec (CA); Christian Brochu, Quebec (CA); Jean Bizouard, Loretteville (CA)

(73) Assignee: 9090-3493 Quebec Inc., Quebec (CA)

( * ) Notice: Subject to any disclaimer, the term of this patent is extended or adjusted under 35 U.S.C. 154(b) by 0 days.

(21) Appl. No.: 10/452,576

(22) Filed: Jun. 3, 2003

(65) Prior Publication Data

US 2004/0244103 A1 Dec. 9, 2004

(51) Int. Cl.[7] ..... A47K 3/00
(52) U.S. Cl. ..... 4/541.1
(58) Field of Search ..... 4/541.1–541.5; 236/12.12; 340/326, 825.69, 825.72

(56) References Cited

U.S. PATENT DOCUMENTS 4,233,694 A 11/1980 Janosko et al.
4,780,917 A 11/1988 Hancock
4,788,725 A * 12/1988 Ediger et al. ..... 4/541.4
4,909,435 A * 3/1990 Kidouchi et al. ..... 236/12.12
5,329,650 A * 7/1994 Zaccai et al. ..... 4/605
RE35,410 E 12/1996 Adcock et al.
5,974,602 A * 11/1999 Theander ..... 4/541.1
5,979,776 A * 11/1999 Williams ..... 236/12.12
6,003,165 A * 12/1999 Loyd ..... 4/541.1
6,253,121 B1 * 6/2001 Cline et al. ..... 700/300
6,282,370 B1 8/2001 Cline et al.
6,317,717 B1 * 11/2001 Lindsey et al. ..... 704/275
6,381,768 B1 5/2002 Herman
2002/0089236 A1 7/2002 Cline et al.

* cited by examiner

*Primary Examiner*—Gregory L. Huson
*Assistant Examiner*—Huyen Le

(57) ABSTRACT

The present invention provides a control panel for controlling operational settings of a spa. The control panel includes a first portion having a first user input device for enabling a user to enter a signal indicative of a desired change in the operational setting of the spa, and a second portion joined to the first portion and having a second user input device for enabling a user to enter a signal indicative of a desired change in the same operational setting of the spa as the first user input device. The first user input device is included within a first user interface positioned such as to facilitate its use by a user situated within the spa. The second user input device is included within a second user interface positioned such as to facilitate use by a user situated outside the spa.

60 Claims, 16 Drawing Sheets

CONTROL PANEL AND CONTROL SYSTEM FOR A SPA

FIELD OF THE INVENTION

The present invention relates to the field of control systems for spa units, and more specifically, to control panels having user interfaces arranged for facilitating use thereof from different locations.

BACKGROUND OF THE INVENTION

Control panels that are operative to enable a user to control one or more operational settings of a spa are known in the art. Typically, such control panels are placed on the outer rim of the spa and include a user interface that is arranged to facilitate operation by a user located outside the spa. Before entering the spa, a user is able to use the control panel in order to set the water temperature and water-jet intensity for example.

A deficiency with control panels of this type is that they are inconvenient and difficult to operate by users located within the spa. More specifically, the positioning and orientation of the control panel make the latter difficult to operate by a user sitting within the spa. Typically, a user located within the spa must exit the comfort of the spa, at least partially, in order to view the control panel and modify a desired spa setting.

Against the background described above, it appears that there is a need in the industry to provide a control panel for a spa that alleviates at least in part the problems associated with the existing control panels.

SUMMARY OF THE INVENTION

In accordance with a broad aspect, the invention provides a control panel suitable for controlling operational settings of a spa. The control panel includes a first portion having a first user input device for enabling a user to enter a signal indicative of a desired change in a certain operational setting of the spa. The control panel also includes a second portion joined to the first portion. The second portion has a second user input device for enabling a user to enter a signal indicative of a desired change in the same certain operational setting of the spa as the first user input device. The first user input device is included within a first user interface that is adapted for being positioned such as to facilitate use by a user situated in a first location. The second user input device is included within a second user interface that is adapted for being positioned such as to facilitate use by a user situated in a second location.

In a specific implementation, the first location is located within the spa, and the second location is located outside the spa.

In a specific implementation, the first portion and the second portion are joined together to form an angle.

In accordance with a first non-limiting implementation, the first portion is adapted to be positioned along an inner wall of the spa and the second portion is adapted to be positioned along a rim wall of the spa.

In accordance with a second non-limiting implementation, the first portion is adapted to be positioned along a rim wall of the spa, and the second portion is adapted to be positioned along an outside wall of the spa.

In accordance with a third non-limiting implementation, the first portion and the second portion are joined via a third portion. The first portion is adapted to be positioned along an inner wall of the spa and the second portion is adapted to be positioned along an outer wall of the spa.

In specific implementations, the portion of the control panel adapted to positioned along an inner wall of the spa shell may be recessed from the inner wall, may protrude from the inner wall, may be substantially aligned with the inner wall or may be positioned at an angle with respect to the inner wall without detracting from the spirit of the invention. When a portion of the control panel is positioned at an angle with respect to the inner wall, the angle will generally be between about 0 degrees and about 45 degrees in either direction from the surface of the inner wall. Similarly, the portion of the control panel positioned along a rim wall of the spa may be recessed from the rim wall, may protrude from the rim wall, may be substantially aligned with the rim wall or may be positioned at an angle with respect to the rim wall without detracting from the spirit of the invention. When a portion of the control is positioned at an angle with respect to the rim wall, the angle will generally be between about 0 degrees and about 45 degrees in either direction from the surface of the rim wall. In addition the portion of the control panel positioned along an outer wall of the spa may be recessed from the outer wall, may protrude from the outer wall, may be substantially aligned with the outer wall or may be positioned at an angle with respect to the outer wall without detracting from the spirit of the invention. When a portion of the control is positioned at an angle with respect to the outer wall, the angle will generally be between about 0 degrees and about 45 degrees in either direction from the surface of the outer wall.

In accordance with a specific example, the first user interface and the second user interface include multiple user input devices for enabling a user to control multiple operational settings of the spa. The user input devices on the first user interface and the user input devices on the second user interface are adapted to control a same set of operational settings of the spa or, alternatively are adapted to control different sets of operational settings of the spa.

In accordance with a broad aspect, the invention provides a control system suitable for controlling operational settings of a spa. The control system includes a first portion having a first user input device for enabling a user to enter a signal indicative of a desired change in a certain operational setting of the spa. The control system also includes a second portion joined to the first portion. The second portion has a second user input device for enabling a user to enter a signal indicative of a desired change in the same certain operational setting of the spa as the first user input device. The control system also includes a control entity in communication with the first user input device and the second user input device for receiving signals indicative of desired changes in the certain operational setting of the spa. The control entity is responsive to a signal received from either one of the first user input device and the second user input device for causing the desired change in the certain operational setting of the spa to be implemented.

In a specific implementation, the control entity is in wire-line communication with either one or both of the first user input device and the second user input device.

In another specific implementation, the control entity is in wireless communication with either one or both of the first user input device and the second user input device. In a non-limiting implementation, the control entity communicates with either one or both of the first user input device and the second user input device over either one of an radio frequency (RF) link or an infra-red IR link.

In a specific implementation, the first portion includes a first user interface where the first user input device is part of the first user interface. In addition, the second portion includes a second user interface where the second user input device is part of the second user interface. The first user interface is adapted to be positioned such as to facilitate use by a user situated within the spa and the second user interface is adapted to be positioned such as to facilitate use by a user situated outside the spa.

In accordance with another broad aspect, the invention provides a spa system including a spa shell, a comfort component and a control system mounted to the spa shell. The control system adapted for causing the generation of signals directed to the comfort component for controlling an operational setting of the spa. The control system includes a control panel and a control entity. The control panel includes a first portion having a first user input device for enabling a user to enter a signal indicative of a desired change in the operational setting of the spa. The control panel also includes a second portion joined to the first portion and having a second user input device for enabling a user to enter a signal indicative of a desired change in the same operational setting of the spa as the first user input device. The control entity is in communication with the first user input device and the second user input device for receiving signals indicative of desired changes in the operational setting of the spa. The control entity is responsive to a signal indicative of a desired change in the operational setting of the spa received from either one of the first user input device and the second user input device for causing the desired change in the operational setting of the spa to be implemented.

In accordance with another broad aspect, the invention provides a control panel suitable for controlling operational settings of a spa. The control panel includes a first portion and a second portion. The first portion has a first user interface including a first user input device for enabling a user to enter a signal indicative of a desired change in a certain operational setting of the spa. The second portion is joined to the first portion and has a second user interface for conveying information related to the certain operational setting of the spa. The first user interface is positioned to facilitate use by a user situated in a first location, and the second user interface is positioned such as to facilitate use by a user situated in a second location.

In a specific implementation, the second user interface includes a display screen for displaying information indicative of the certain operational setting of the spa. Alternatively, the second user interface includes an audio output device for issuing an audio signal conveying the certain operational setting of the spa.

In accordance with yet another broad aspect, the invention provides a control panel suitable for controlling an operational setting of a spa. The control panel includes a first portion having first means for enabling a user to enter a signal indicative of a desired change in the operational setting of the spa. The control panel also includes a second portion joined to the first portion. The second portion has second means for enabling a user to enter a signal indicative of a desired change in the same operational setting of the spa at the first means. The first means is adapted for being positioned such as to facilitate use by a user situated in a first location, and the second means is adapted for being positioned such as to facilitate use by a user situated in a second location.

BRIEF DESCRIPTION OF THE DRAWINGS

A detailed description of examples of implementation of the present invention is provided hereinbelow with reference to the following drawings, in which.

Figure 1:
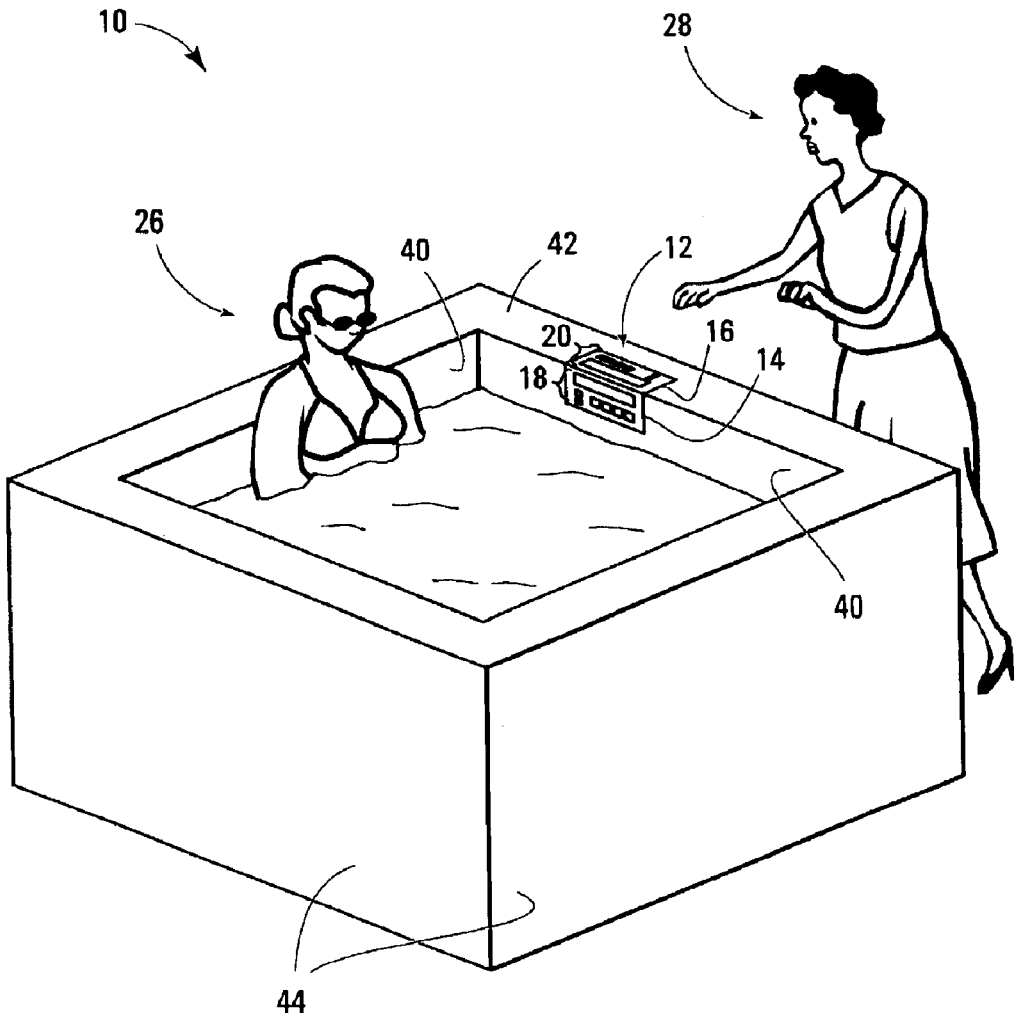
FIG. 1 shows a spa equipped with a control panel in accordance with a first specific example of implementation of the present invention.

In the drawings, embodiments of the invention are illustrated by way of example. It is to be expressly understood that the description and drawings are only for the purposes of illustration and as an aid to understanding, and are not intended to be a definition of the limits of the invention.

DETAILED DESCRIPTION

Shown in FIG. 1 is a spa 10 that is equipped with a control panel 12 in accordance with a specific example of implementation of the present invention. The control panel 12 is operative to enable a user to control at least one operational setting of the spa.

It should be understood that the term "spa", as used for the purposes of the present description, refers to spas, whirlpools, hot tubs, bath tubs, swimming pools and any other type of bathing receptacle that can be equipped with a control panel for controlling various operational settings. Some non-limiting examples of operational settings of the spa include an on/off setting, a temperature control setting, jet control settings and lighting settings. It should also be appreciated that, where the spa is connected to entertainment and/or multimedia modules, the operational settings of the spa may also include audio settings and video settings amongst others. Consequently, the expression "operational settings" for the purpose of the present invention is intended to cover operational settings for any suitable equipment that can be used by the spa bather.

As shown in FIG. 1, the control panel 12 includes a first portion 14, and a second portion 16 that is joined to the first portion 14. As can best be seen in the enlarged view of control panel 12 shown in FIG. 2, the first portion 14 includes a first user interface 18, and the second portion 16 includes a second user interface 20. Both the first user interface 18 and the second user interface 20 include user input devices 21. The user input devices 21 enable a user to enter signals indicative of desired changes in the operational settings of the spa. In the specific control panel 12 depicted in FIG. 2, the user-input devices are shown as buttons forming keypads 22. In addition, in the example shown in FIG. 2 both the first user interface 18, and the second user interface 20, include a display screen 24.

It should be understood that the physical implementations of user interfaces 18 and 20 can vary greatly without departing from the spirit of the invention. For example, the user interfaces 18 and 20 are not limited to including a keypad 22 and instead can include any combination of user input devices, such as levers, toggle switches, keyboard, touch sensitive screen, microphone connected to a voice recognition unit, an infra-red receiver for receiving signal from a remote control device or any other suitable user input device known in the art for allowing an operator to enter commands relating to the operational settings of the spa. In addition, the display screens 24 are optional components for user interfaces 18 and 20.

In an alternative physical implementation (shown FIG. 5F of drawings), at least some user-input devices may be shared between the first user interface 18 and the second user interface 20. In a first specific example of such an alternative physical implementation, user interfaces 18 and 20 intersect along an edge and the input devices are located along that edges such as to be conveniently accessed from two different locations. In a second specific example of such an alternative physical implementation, the first interface includes a set of user-input devices in the form of switches. The second user interface includes second input devices in the form of mechanical levers adapted to actuate the user-input devices in the first user interface such that the user-input devices located on the first user interface are accessible from the first user interface and the second user interface.

In another alternative physical implementations (not shown in the drawings), the user input devices may be omitted from either one of the first user interface 18 or second user interface 20. In such alternative physical implementations, the user interface without user input devices is adapted for conveying information related to the operational settings of the spa. This may be effected through any suitable output device including without being limited to a display screen, a set of one or more LEDs, an audio output device such as a speaker or any other suitable output device known in the art for conveying to a user information related to the operational settings of the spa. The output device may be controlled by any suitable device driver. Such device drivers are well known in the art and as such will not be described further here.

As will be described in more detail further on, in a specific implementation, at least one operational setting of the spa can be controlled from both the first user interface 18 and the second user interface 20. For example, both the first user interface 18 and the second user interface 20 include a user input device that is operative to control the same operational setting of the spa. Advantageously, this allows a user to control at least one operational setting of the spa from both the first user interface 18 and the second user interface 20. For example, both the first user interface 18 and the second user interface 20 can include an on/off button that is able to turn the spa on and off.

It should also be understood that user interfaces 18 and 20 can include any number of user input devices in order to enable a user to control any number of operational settings of the spa. For example, the user interfaces 18 and 20 may include only one user input device, such as a single button, for enabling a user to control only one operational setting of the spa, such as an on/off setting. Alternatively, the one user input device could be a touch sensitive screen or microphone, through which the user can control multiple operational settings of the spa. In the example shown in FIG. 2, the user interfaces 18 and 20 include a number of user input devices, in the form of buttons 21, in order to enable a user to control multiple operational settings of the spa. More specifically, each button 21 corresponds to a different operational setting. Alternatively, an operational setting selection input is provided such as to allow a same button to correspond to multiple operational settings depending on the operational setting selected by the operational setting selection input.

Referring back to FIG. 1, it is shown that the first user interface 18 is arranged to facilitate use by a user 26 situated in a first location, and the second user interface 20 is arranged to facilitate use by a user 28 situated in a second location. In the specific example of implementation shown in FIG. 1, the user 26 situated in the first location is situated within the spa 10, and the user 28 situated in the second location is situated outside the spa 10. As such, any symbols or text included on the first user interface 18, either to identify buttons on the keypad 22 or displayed on the display screen 24, are arranged to facilitate reading by user 26 located in the spa. Likewise, any symbols or text included on the second user interface 20, are arranged to facilitate reading by user 28 located outside the spa. In this way, regardless of whether a user is located within the spa, or outside the spa, the user is not forced to adopt an uncomfortable position in order to be able to easily read text or symbols displayed on a user interface of the spa.

In the specific example of control panel 12, the first user interface 18 is substantially the same as the second user interface 20, thereby providing user 26 located within the spa with the same functionality as user 28 located outside the spa. The second user interface 20 includes substantially the same user input devices as the first user interface 18 such that a user is able to enter substantially the same commands indicative of desired changes in the operational settings of the spa at the first user interface 18 and at the second user interface 20. For example, for each operational setting that can be controlled via the second user interface 18, the same operational setting can be controlled via the first user interface 20. More specifically, the first user interface 18 includes a first set of user input devices adapted for enabling a user to control a set of operational settings of the spa. The second user interface 20 includes a second set of user input devices adapted for enabling a user to control the same set of operational settings of the spa as the first set of user input devices. This allows a user to cause desired changes in the same set of operational settings of the spa at the first user interface and at the second user interface.

It should be understood that in alternative examples of implementation, the functionality provided by the first user interface 18 is different from the functionality provided by the second user interface 20. For example, an operational setting that can be controlled via one user interface may not be controlled via the other user interface.

Figure 3:
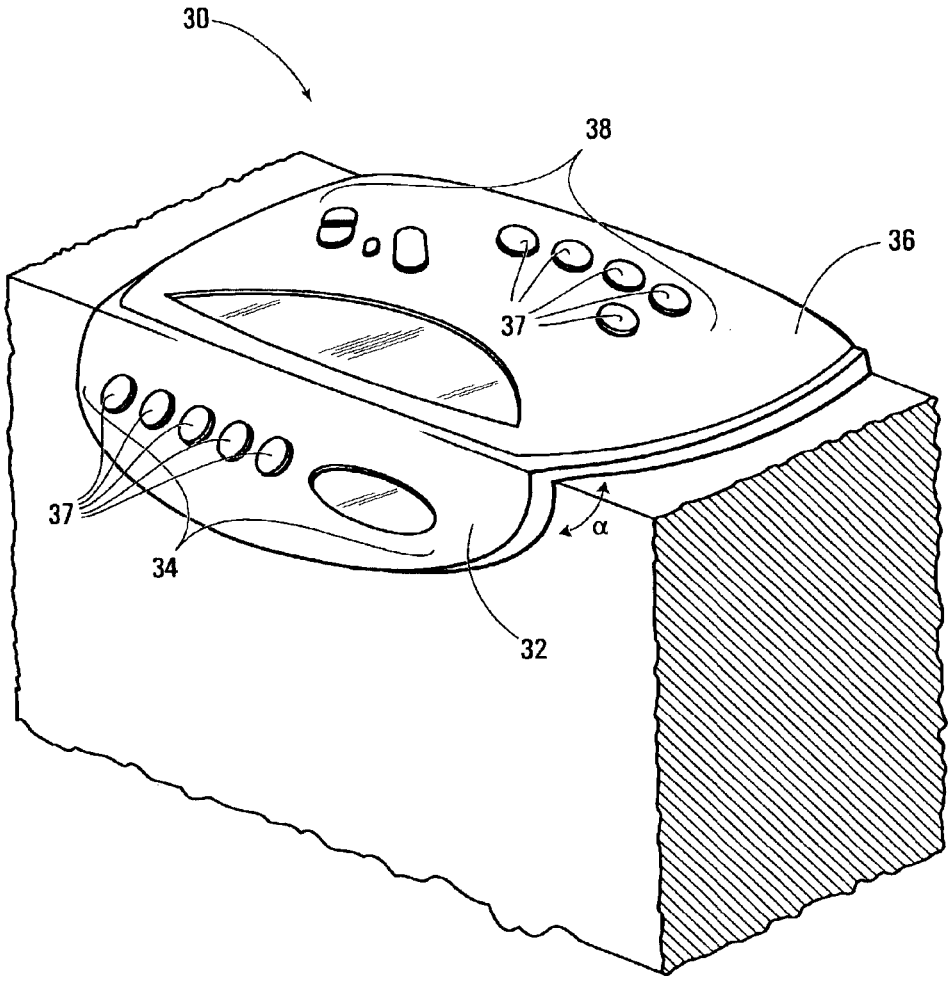
FIG. 3 shows a specific example of a control panel in accordance with a second example of implementation of the present invention.

Shown in FIG. 3 is a control panel 30 that includes a first portion 32 having a first user interface 34, and a second portion 36 having a second user interface 38. In this non-limiting example, the second user interface 38 includes more user input devices 37 than the first user interface 34. As such, the second user interface 38 enables a user to control different operational settings of the spa from those controllable from the first user interface 34. For example, the second user interface 38 includes at least one user input device 37 that enables a user to enter a signal indicative of a desired change in an operational setting at the second user interface 38 that the user is not able to enter at the first user interface 34. More specifically, the first user interface 34 includes a first set of user input devices adapted for enabling a user to control a first set of operational settings. The second user interface 38 includes a second set of user input devices adapted for enabling a user to control a second set of operational settings. The second set of operational settings including at least one operational setting absent from the first set of operational settings such as to allow a user to cause desired changes in different sets of operational settings of the spa at the first user interface and at the second user interface. It should be understood that in an alternative embodiment, the second user interface 38 might have a reduced functionality compared to the first user interface 34.

Control panels in accordance with the present invention, such as control panels 12 and 30 described above, are adapted to be positioned on spas of the type shown in FIG. 1, such that the two user interfaces are arranged to facilitate use by users located in different positions. In addition, in accordance with a non-limiting implementation, the control panels may be installed on a spa shell using a single hole punctured in the shell of the spa. This facilitates ease of installation, and also reduces the likelihood of leaks that are caused by having multiple holes punctured in the shell of the spa.

Spa 10, shown in FIG. 1, includes a spa shell having four inner walls 40, a rim wall 42 and four outer walls 44. It should, however, be understood that control panels in accordance with the present invention can be installed on spa shells having any number of inner and outer walls made in any shape and size. For example, many spa shells include more or less than four inner walls 40, and have inner walls 40 that are angled and/or curved. The same thing is true of the outer walls 44. Many spa shells include more or less than four outer walls 44, and have outer walls 44 that are angled and curved. The term "rim wall" as used for the purposes of the present invention, can be any wall that acts to join the inner walls 40 with the outer walls 44. The rim wall 42 can be curved, angled or molded into any suitable shape.

In a specific implementation, the control panel is mounted to the spa shell such that one portion of the control panel is positioned to be accessed from inside the spa and the other portion is positioned to be access from outside the spa. The control panel may be flush with the spa shell, may protrude from spa shell or may be recessed from the spa shell without detracting from the spirit of the invention.

The first portions and second portions can be joined in a variety of different configurations. In a first specific configuration, the first portions and second portions are adapted to straddle the spa shell. In a second specific configuration, the first portions and second portions are part of a control panel body adapted to be positioned in a recessed portion of the spa shell. In a third specific configuration, the first portions and second portions are part of a control panel body adapted to be positioned atop a rim wall of the spa shell. A few, specific, non-limiting examples of how the first portions and second portions can be joined will be described in more detail below.

Figure 2:
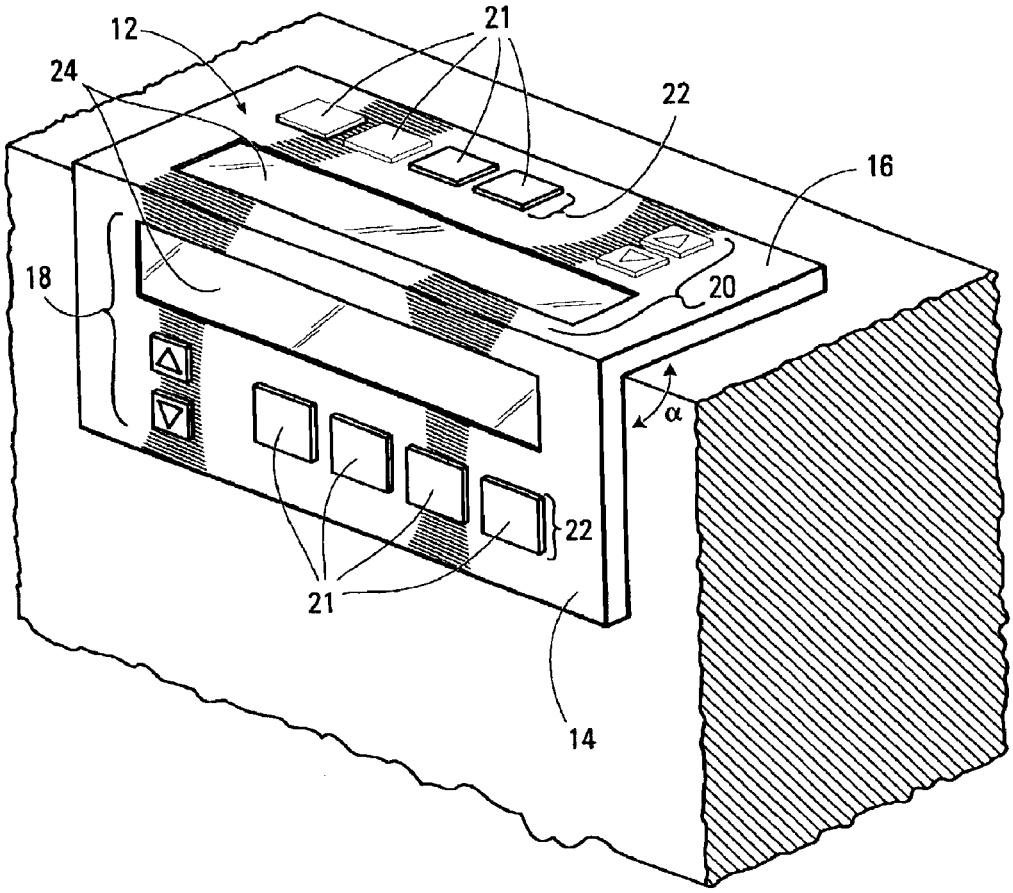
FIG. 2 shows an enlarged view of the control panel shown in FIG. 1.
Figure 4:
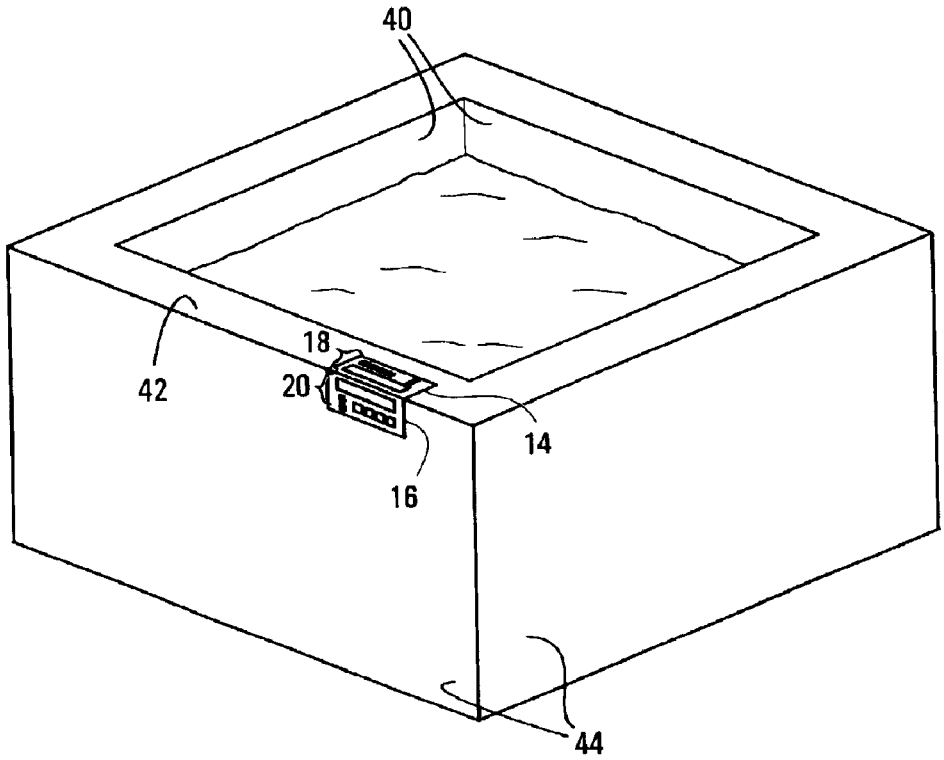
FIG. 4 shows the control panel shown in FIG. 1 positioned in a different configuration on a spa, in accordance with a specific example of implementation of the present invention.

As shown in FIG. 2, the first portion 14 and the second portion 16 of control panel 12 are joined at an angle $\alpha$ corresponding essentially to the angle formed between the rim wall and the inner wall where the control panel 12 is to be installed. In FIG. 2, this angle is shown as being an angle of about 90°. As such, in the configuration shown in FIG. 1 the control panel 12 is able to be positioned on the spa 10 such that the first portion 14 is positioned along an inner wall 40 of the spa, and the second portion 16 is positioned along a rim wall 42 of the spa. In FIG. 4, control panel 12 is shown positioned on spa 10 in a different configuration, wherein the first portion 14 is positioned along a rim wall 42 of the spa and the second portion 16 is positioned along an outer wall 44. In both of these configurations, the first user interface 18 is arranged to facilitate use by a user situated within the spa and the second user interface 20 is arranged to facilitate use by a user situated outside the spa.

As for control panel 30 shown in FIG. 3, the first portion 32 and the second portion 36, are also joined at an angle $\alpha$ of about 90°, such that the control panel 30 can be positioned on spa 10 in the same types of configurations as described above with respect to control panel 12.

Figure 5A:
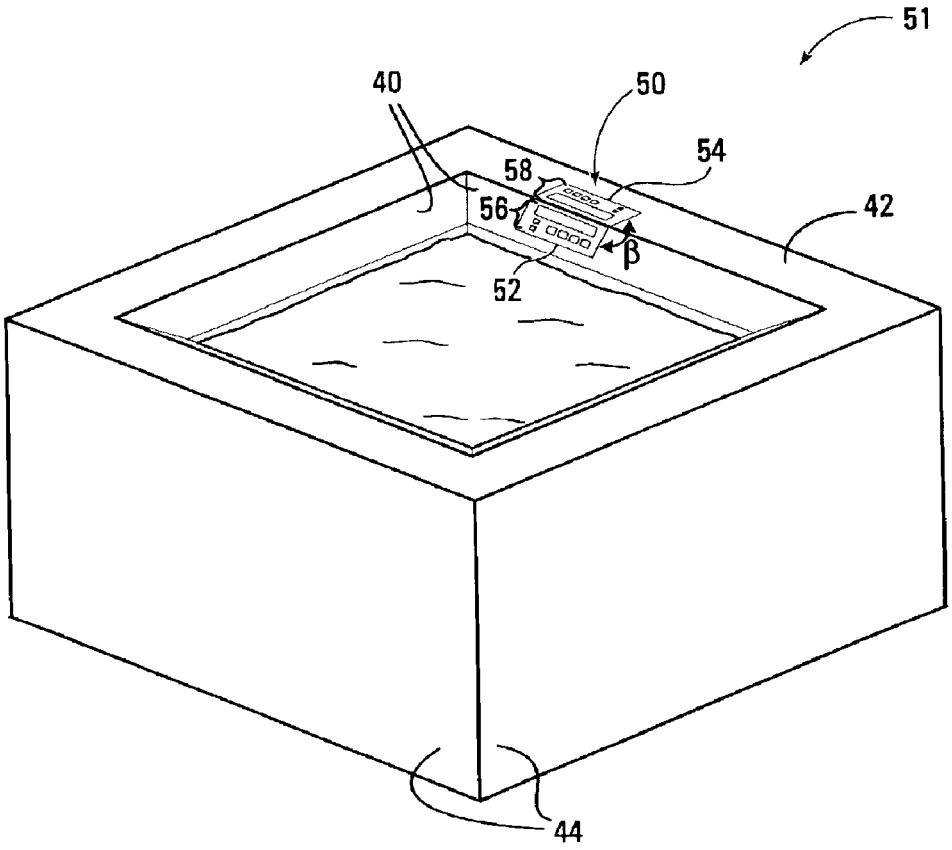
FIG. 5A shows a spa equipped with a control panel in accordance with a third specific example of implementation of the present invention.

Shown in FIG. 5A is a control panel 50 in accordance with a third specific example of implementation of the present invention. Control panel 50 includes a first portion 52 having a first user interface 56, and a second portion 54 having a second user interface 58. The first portion 52 and the second portion 54 are joined at an angle $\beta$, such that the control panel 50 can fit properly on a spa shell having an angled inner wall, such as spa 51 shown in FIG. 5A. It should be understood that the first portion 52 and the second portion 54 can be joined at any angle $\beta$ that permits the two portions of the control panel 50 to be positioned along a combination an inner wall and a rim wall of a spa or a rim wall and an outer wall of a spa. In a specific embodiment of control panel 50, angle $\beta$ is an angle between about 45° and about 170°. In the example shown in FIG. 5*a*, angle $\beta$ is an obtuse angle. In an alternative example, the angle $\beta$ may be an acute angle allowing the control panel to be positioned along a combination an inner wall and a rim wall of a spa shell or a rim wall and an outer wall of a spa shell forming an acute angle.

Figure 5B:
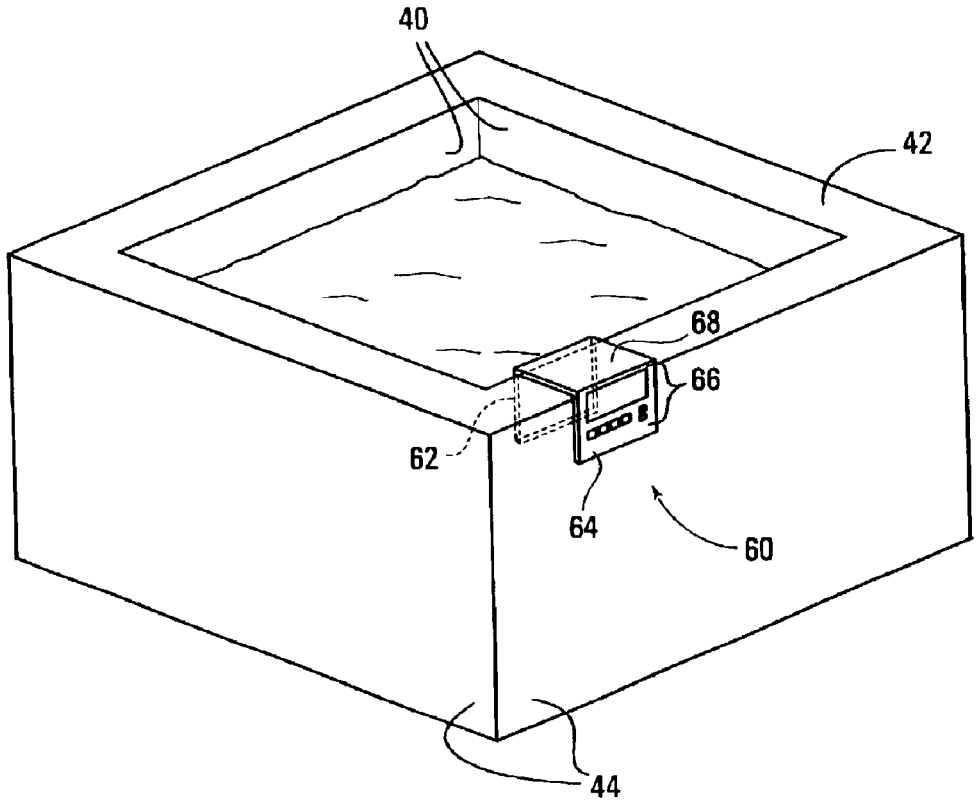
FIG. 5B shows a spa equipped with a control panel in accordance with a fourth specific example of implementation of the present invention.

Shown in FIG. 5B is a control panel 60 in accordance with a fourth specific example of implementation of the present invention. Control panel 60 includes a first portion 62 having a first user interface (not shown), and a second portion 64 having a second user interface 66. The first portion 62 and the second portion 64 are joined together via a third portion 68. As such, control panel 60 can be positioned on the spa such that the first portion 62 is positioned along an inner wall of the spa shell and the second portion 64 is positioned along an outer wall of the spa shell. In this configuration, the first user interface (not shown) is arranged to facilitate use by a user situated within the spa and the second user interface 66 is arranged to facilitate use by a user situated outside the spa.

Figure 5C:
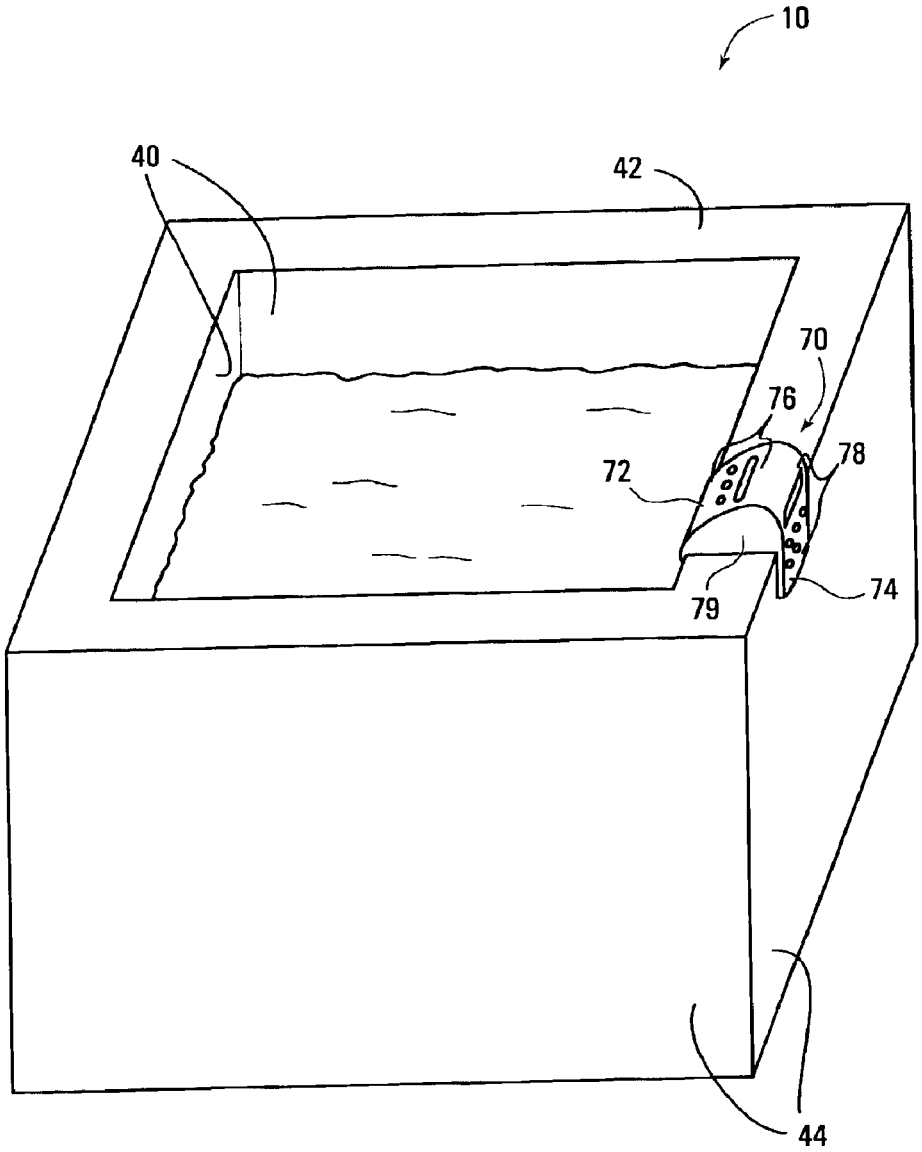
FIG. 5C shows a spa equipped with a control panel in accordance with a fifth specific example of implementation of the present invention.

A control panel 70 in accordance with a fifth specific example of implementation of the present invention is shown in FIG. 5C. Control panel 70 includes a first portion 72 having a first user interface 76 and a second portion 74 having a second user interface 78. The first portion 72 and the second portion 74 are joined together by body 79. Control panel 70 is adapted to be positioned on spa 10 such that the first user interface 76 is arranged to facilitate use by a user situated within the spa and the second user interface 78 is arranged to facilitate use by a user situated outside the spa.

Figure 5D:
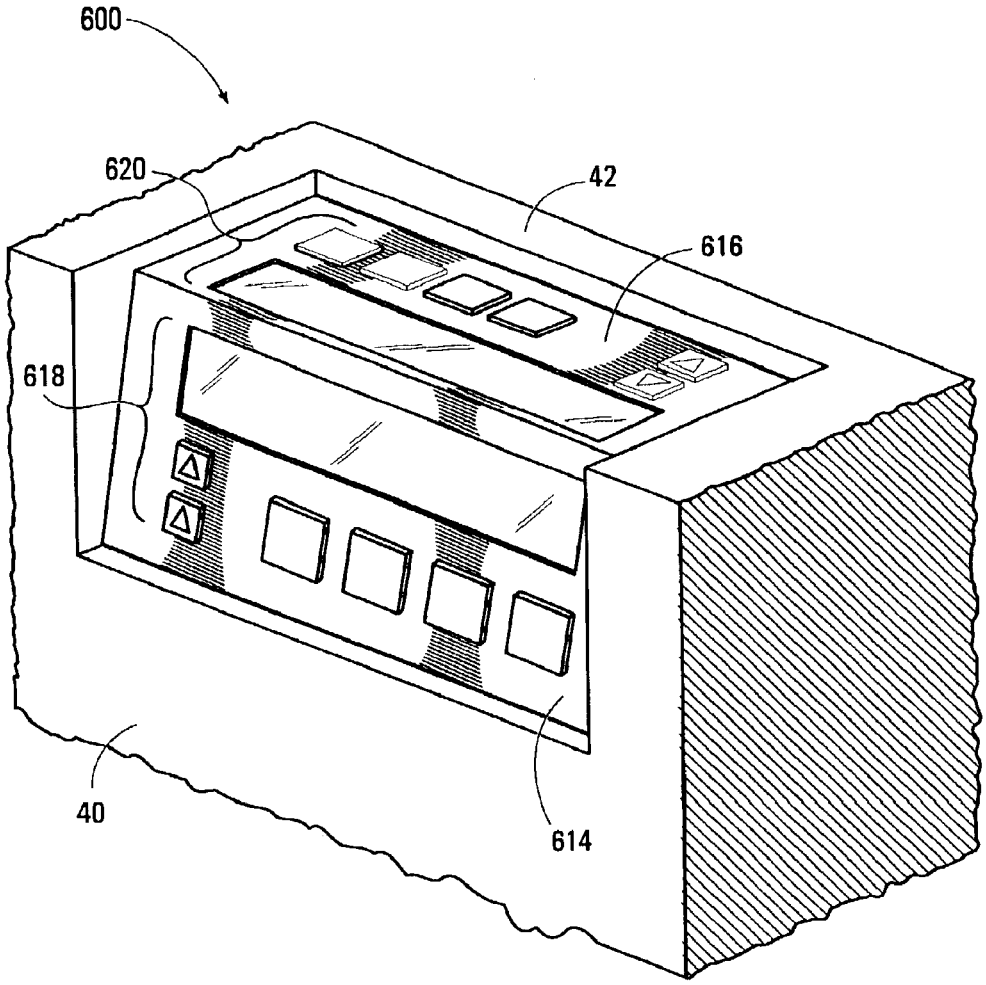
FIGS. 5D and 5E show a spa equipped with a control panel in accordance with a sixth specific example of implementation of the present invention.
Figure 5E:
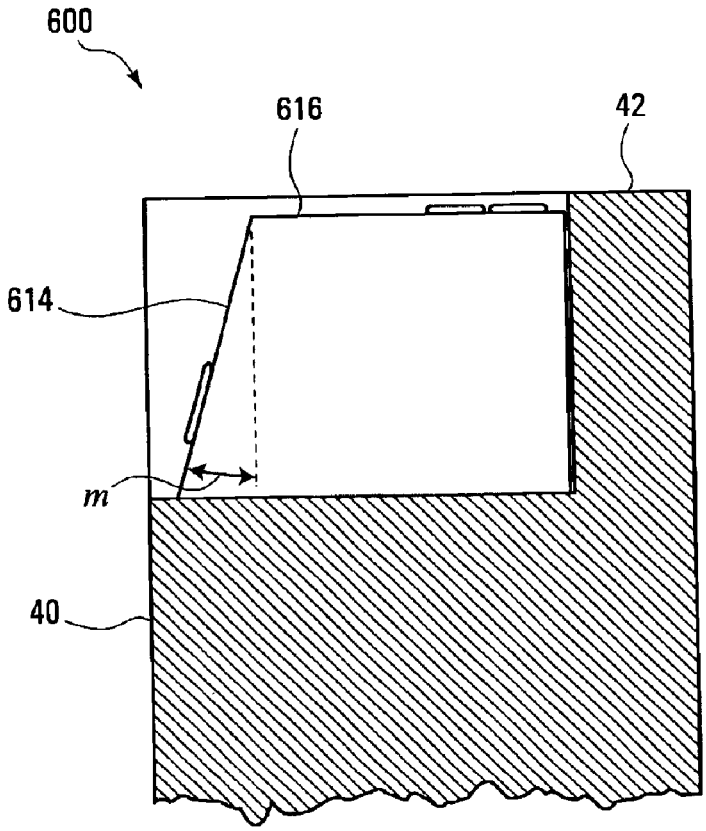

A control panel 600 in accordance with a sixth specific example of implementation of the present invention is shown in FIG. 5D. Control panel 600 includes a first portion 614 having a first user interface 618 and a second portion 616 having a second user interface 620. The first portion 614 and the second portion 616 are joined together by body 500. Control panel 600 is adapted to be positioned in a recessed portion of the spa shell. In the example shown in FIG. 5D, the first portion 614 of the control panel 600 is positioned along an inner wall 40 of the spa shell. It will be appreciated that the first portion 614 may be recessed from the inner wall, may protrude from the inner wall, may be substantially aligned with the inner wall or may be positioned at an angle with respect to the inner wall without detracting from the spirit of the invention. When the portion 614 of the control panel 600 is positioned at an angle with respect to the inner wall 40, the angle will generally be between about 0 degrees and about 45 degrees in either direction from the surface of the inner wall. FIG. 5E of the drawings illustrates a side elevation of control panel 600 positioned such that the first portion 614 of the control panel 600 is positioned along the inner wall 400, recessed therefrom and at an angle "m" with respect to the inner wall.

Figure 5F:
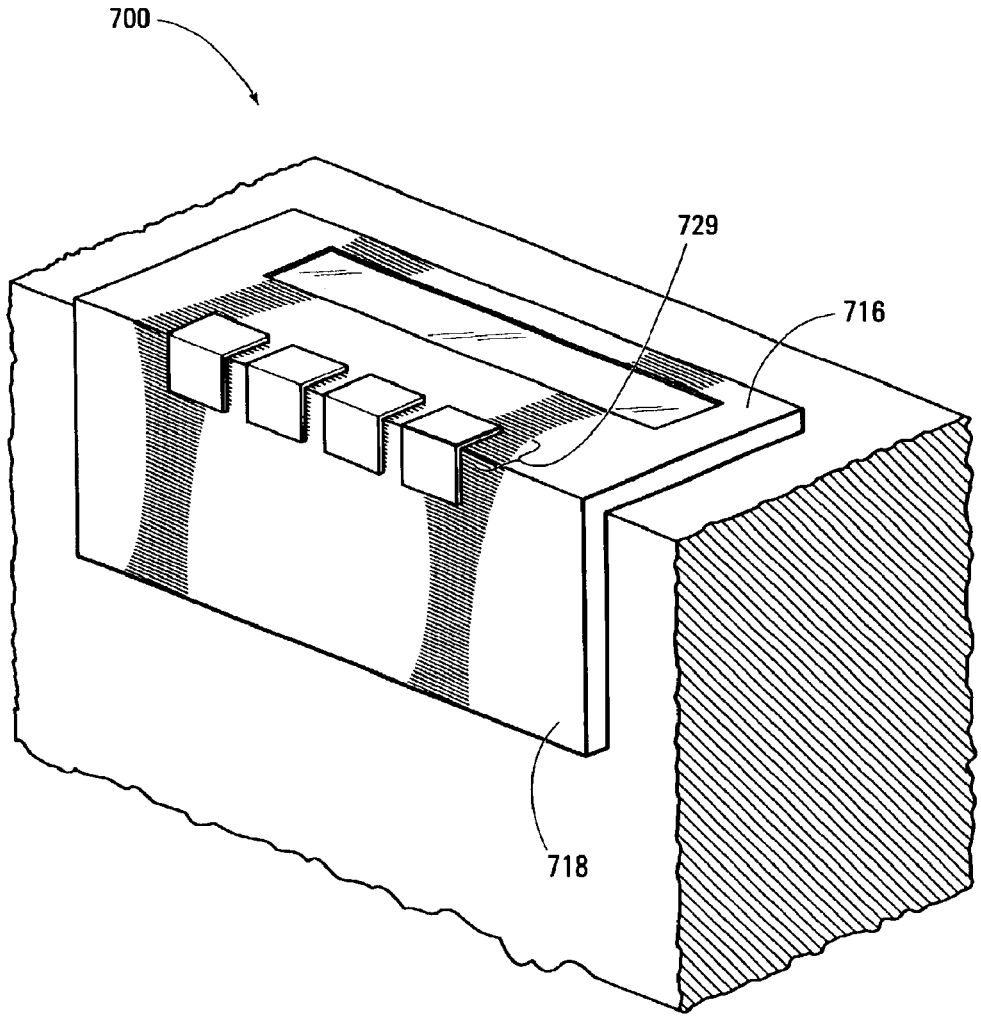
FIG. 5F shows a spa equipped with a control panel in accordance with a seventh specific example of implementation of the present invention.

A control panel 700 in accordance with a seventh specific example of implementation of the present invention is shown in FIG. 5F. Control panel 700 includes a first portion 718 and a second portion 716. At least some user-input devices 722 are shared between the first user interface and the second user interface. As shown, the first portion and the second portion intersect along an edge and the input devices 722 are located along that edge such as to be conveniently accessed from two different locations.

Figure 8A:
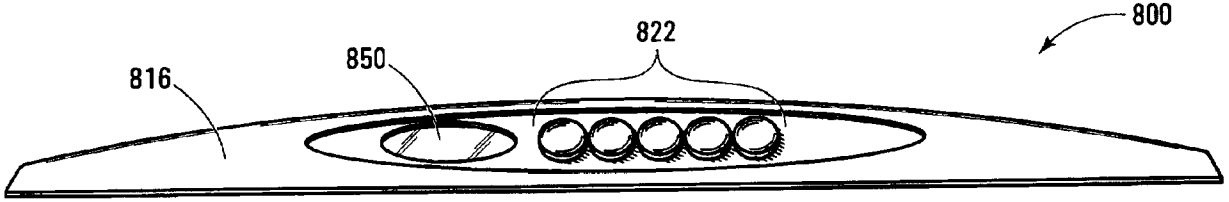
FIGS. 8A, 8B, 8C, 8D, 8E, 8F show a specific example of a control panel in accordance with an eighth example of implementation of the present invention.
Figure 8B:
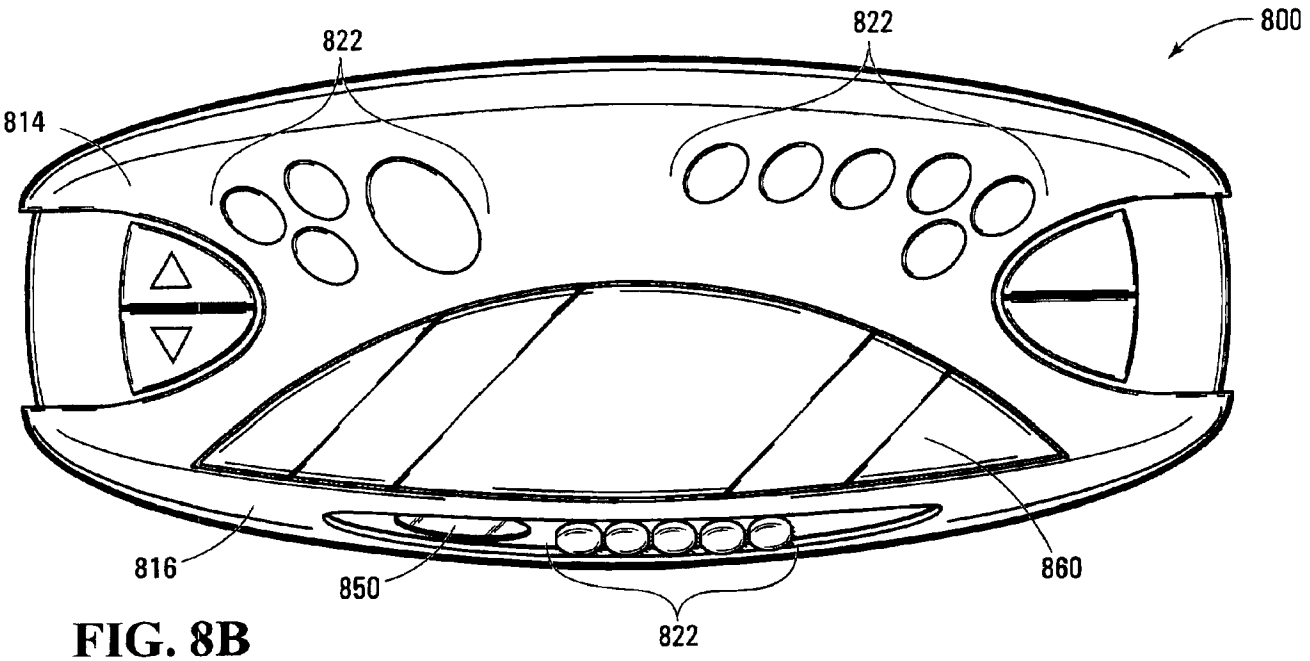
Figure 8C:
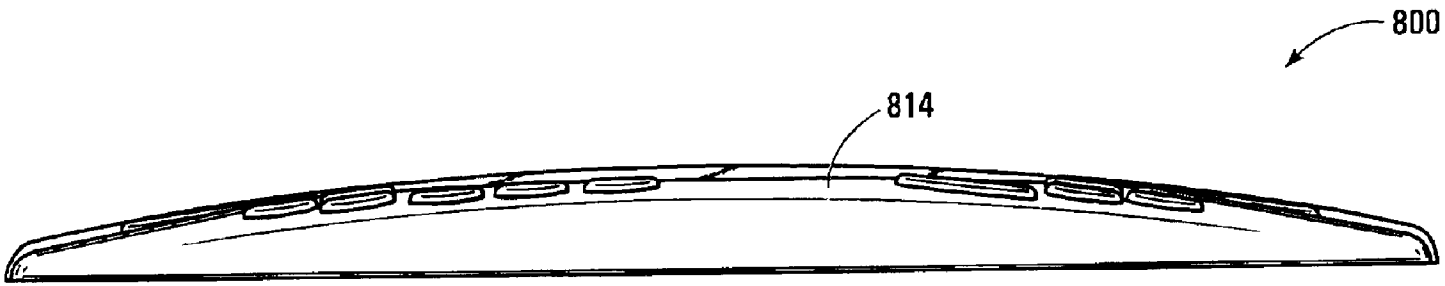
Figure 8D:
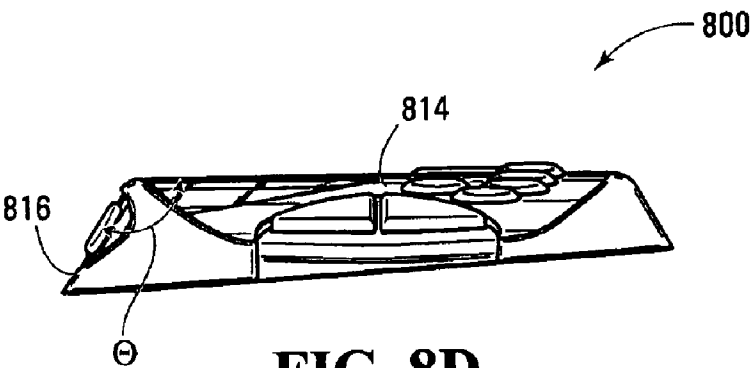
Figure 8E:
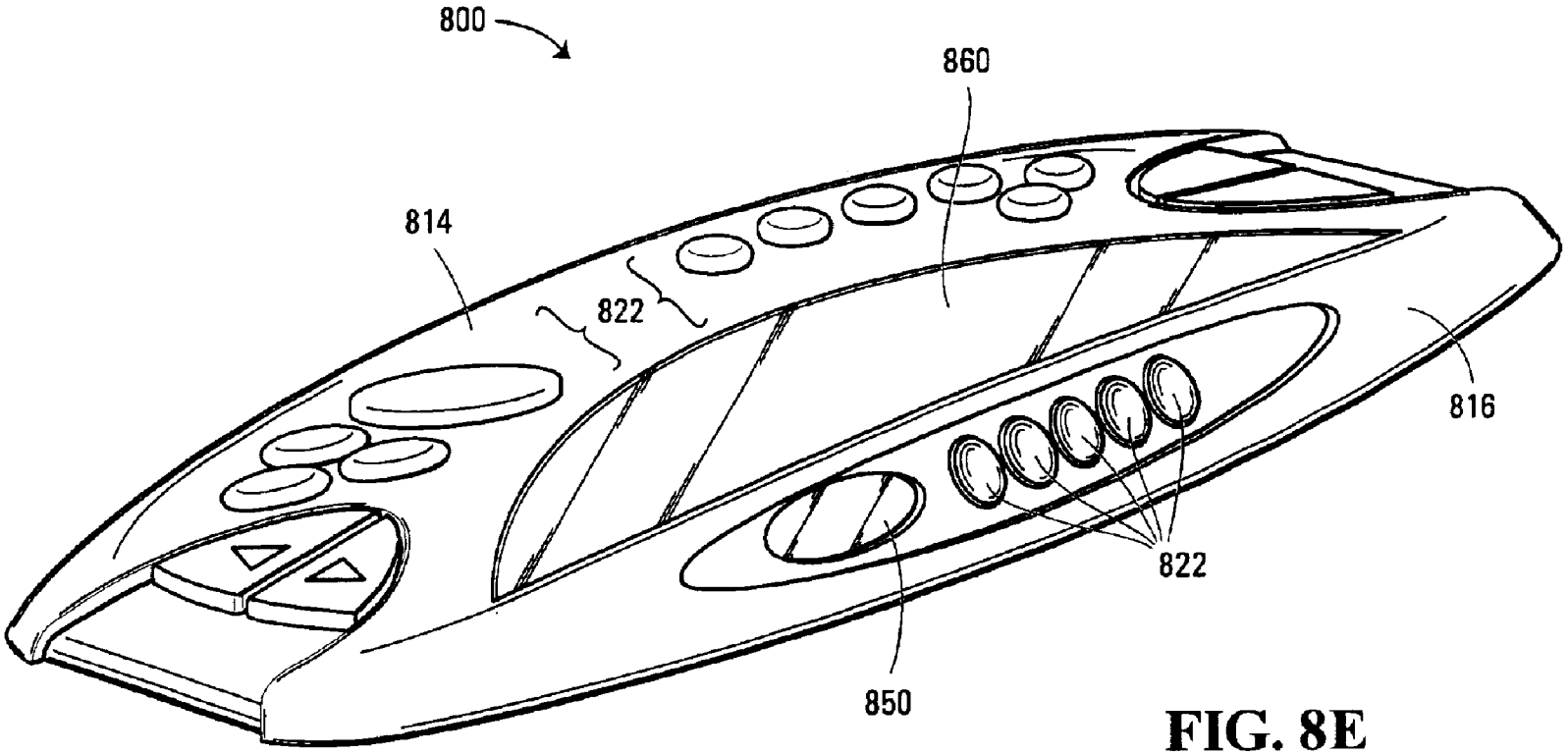
Figure 8F:
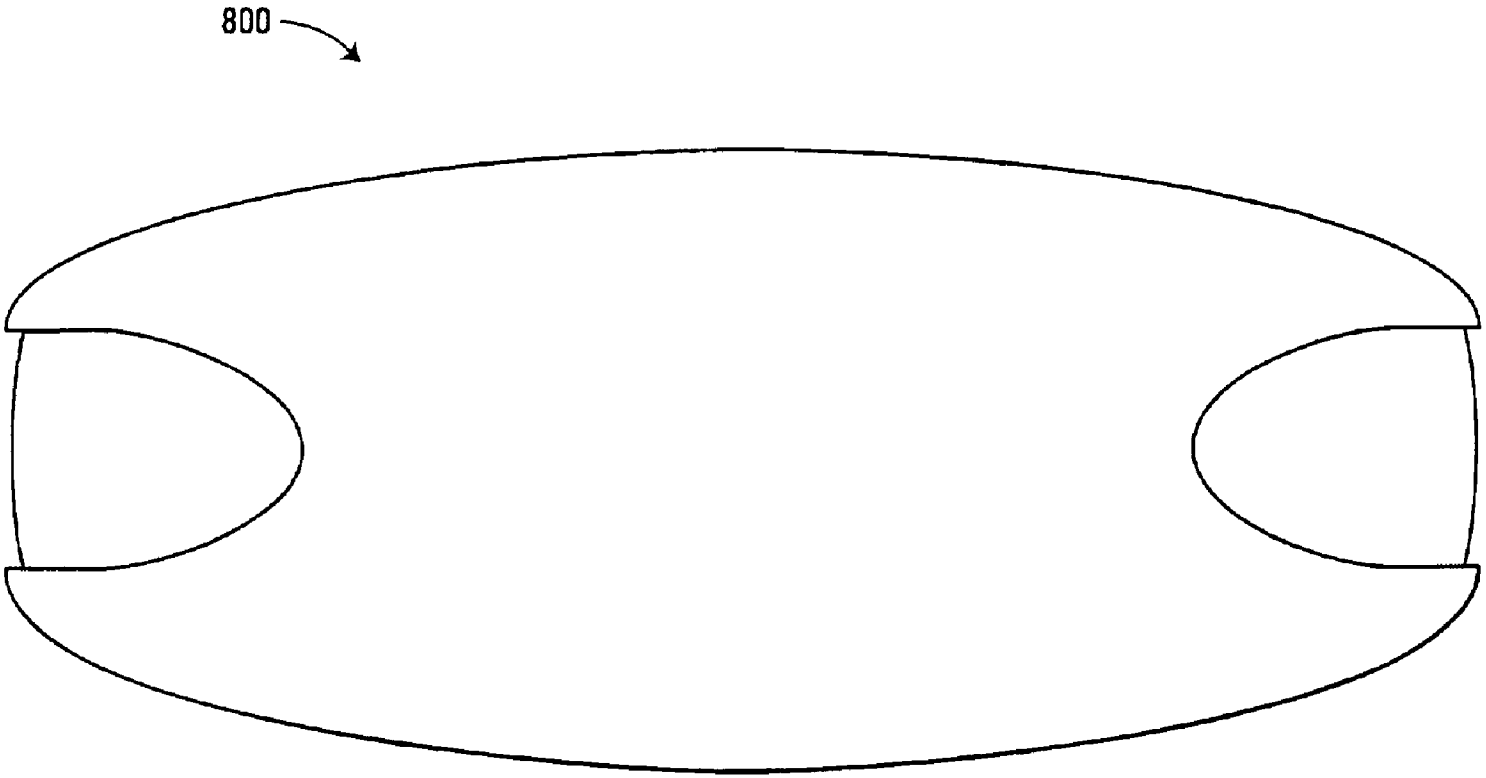

A control panel 800 in accordance with a eighth specific example of implementation of the present invention is shown in FIGS. 8*a*, 8*b*, 8*c*, 8*d*, 8*e* and 8*f*. FIG. 8*a* shows a front elevation view of the control panel 800. FIG. 8*b* shows a top plan view of the control panel 800. FIG. 8*c* shows a rear elevation view of the control panel 800. FIG. 8*d* shows a side elevation view of the control panel 800. FIG. 8*e* shows a perspective view of the control panel 800. FIG. 8*f* shows a bottom view of the control panel 800. Control panel 800 includes a first portion 814 having a first user interface and a second portion 816 having a second user interface. The first portion 814 and the second portion 816 are joined together by a body. Control panel 800 is adapted to be positioned either in a recessed portion of the spa shell or atop the spa shell. The first portion 814 and the second portion 816 form an angle θ there between. The angle θ can be of any suitable value. In a non-limiting implementation, the angle θ is between about 45 degrees and about 170 degrees. The first user interface and second user interface include respective display screens 860 and 850 for conveying information regarding operational settings of the spa. The first user interface and second user interface also include respective input devices 822 for enabling a spa user to provide commands for modifying operational settings of the spa.

It should be understood that the above described control panels are specific, non-limiting examples of implementation of control panels in accordance with the present invention, and that other embodiments and configurations of control panels in accordance with the present invention can be envisaged by the person skilled in the art in light of the present specification.

Figure 6:
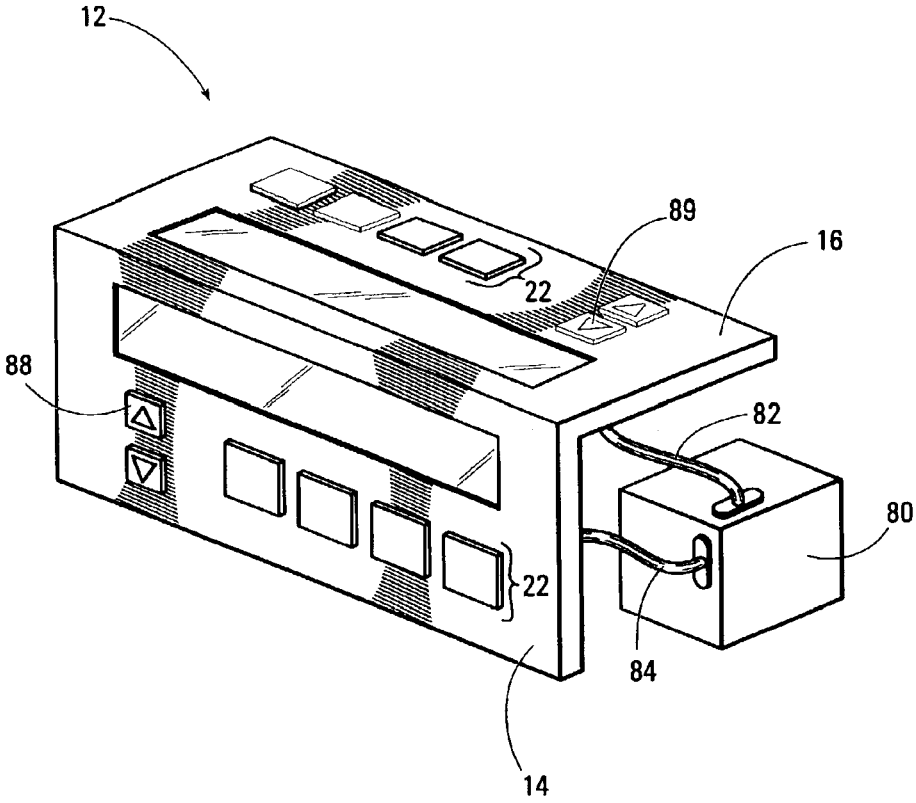
FIG. 6 shows the control panel from FIG. 1 in communication with a control entity, in accordance with a specific example of implementation of the present invention.

Referring now to FIG. 6, control panel 12 is shown in communication with a control entity 80 for implementing the desired changes to the operational settings of the spa, as entered by the user via the first user interface 18 and the second user interface 20. Although control panel 12 will be used for the purposes of the following description, it should be understood that any one of the control panels 30, 50, 60 or 70 described above are also adapted to be used in conjunction with a control entity 80.

The control entity 80 is in communication with the user input devices of the first user interface and the user input devices of the second user interface for receiving signals indicative of desired changes in the certain operational setting of the spa. The control entity 80 is responsive to a signal received from a user input device in either one of the first user interface and the second user interface indicative of a desired change in the certain operational setting of the spa for causing the desired change in the certain operational setting of the spa to be implemented. Optionally, control entity 80 is also in communication with either one or both of the first user interface and second user interface for issuing control signal for controlling output devices, such as a display screen, LEDs or speaker, for conveying information related to an operational setting of the spa.

The control entity 80 may be part of the control panel 12 or may be part of a centralized control system adapted for controlling various spa components. As such the control entity may be positioned in proximity to the control panel 12 or remotely therefrom without detracting from the spirit of the invention. In addition, the functionality implemented by control entity 80 may be implemented in one or more processors and/or micro-controllers which may be distributed in different physical locations or which may be positioned in a same location. In a non-limiting implementation, control entity 80 is part of a spa control pack and is positioned remotely from the control panel 12. However, other possible mounting positions for control entity 80 can also be used without departing from the spirit of the invention.

In the specific embodiment shown in FIG. 6, control entity 80 is in communication with the user inputs of the first and second portions 14 and 16, which in the case of control panel 12 are the buttons of keypads 22, via a communication link. The communication link may be any suitable link such as a wireline link, an infrared link, a radio frequency link or other suitable wireless links.

In order to cause the desired changes in the operational settings to be implemented, the control entity is in communication with actuators that are operable to implement the desired changes in the operational setting by selectively actuating comfort components. Such actuators may be in the form of relays and solid-state switches for example. Comfort components may include without being limiting to a heating element, pump, blower, valve, ozonator, sanitization system, a lighting element, audio equipment video equipment and computer equipment. The computing unit 80 includes the suitable logic for receiving and processing a command indicative of a desired operational setting for the spa such as to generate appropriate signals for causing the operational settings to be set to the desired values. For example, in the case where the command is indicative of a desire to have the temperature in the water increased, the control entity 80 issues a signal to a heating element to cause the temperature of the water to be increased to the desired temperature. The manner in which the water temperature is set to a desired temperature may be effected in any manner well known in the art and as such will not be described further here. The example of increasing the temperature of the water is simply being used for the purposes of illustration, and it should be understood that any other controllable function of the spa could also have been used for the purposes of this description. Optionally, the computing unit 80 includes the suitable logic for issuing signals to either one or both of the first user interface and second user interface for causing output devices, such as a display screen, LEDs or speaker, to conveying information related the temperature of the water such as the desired water temperature, the actual water temperature or both.

Figure 7:
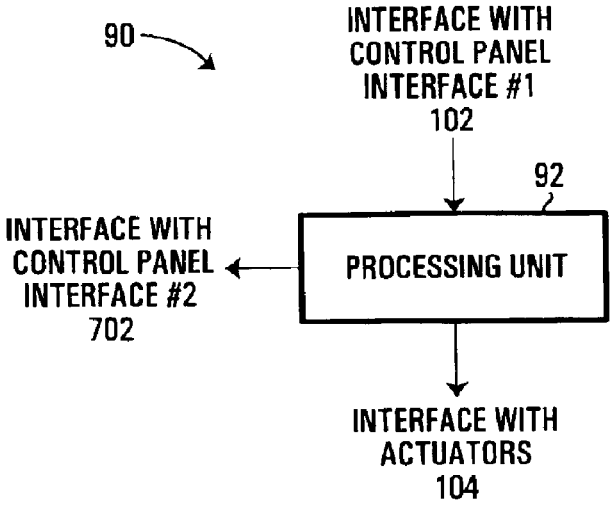
FIG. 7 shows a block diagram of a computing unit for implementing the functionality of the control entity shown in FIG. 6.

The computing unit 80 may be configured as a computing apparatus 90 of the type depicted in FIG. 7, including a processing unit 92 and a set of interfaces 102 702 and 104 for receiving or sending data elements to external devices. The processing unit 92 is adapted to implement the desired changes in the operational settings as described in the specification. For example, interface 102 receives/transmits signals the first user interface of the control panel described above. Interface 702 receives/transmits signals the second user interface of the control panel 12 described above. The processing unit 92 is operative for processing the signals received from either interface 702 or 102 to derive local signals for transmission to the actuators, in order to have the desired change in the operational setting implemented. Interface 104 is for releasing the local signals to the actuators for causing the desired changes to be implemented. The processing unit 92 is operative for issuing signals directed to either interface 702 or 102 or both to cause the user interfaces through suitable output devices to convey information related to operational setting of the spa. In a non-limiting implementation, the processing unit 92 is operative for issuing signals directed to an output driver module associated to the control panel interfaces. In the case where the user interfaces include a display, the interface 102 and 701 are adapted for releasing signals to display drivers associated to the user interfaces of the control panel for causing the display to convey information related to operational setting of the spa. Where the control panel is of the type shown in FIG. 6, the interface 702 may cause the same information to be conveyed by the first portion 14 of the control panel and by the second portion 16. Alternatively, the interface 702 may cause different information to be conveyed by the first portion 14 of the control panel and by the second portion 16 of the control panel.

As mentioned earlier, in use, a user uses the user input devices located on either one of the first and second portions of the control panels in order to input a command indicative of a desired change in an operational setting of the spa. For example, in the case of control panel 12 shown in FIG. 6, the first user interface 18 of the first portion 14 includes a button 88 for enabling a user to increase the temperature of the water in the spa. Similarly, the second user interface 20 of the second portion 16 includes a button 89 that is also for enabling a user to raise the temperature of the water in the spa. As such, a user can use either one of buttons 88 or 89 in order to enter a command for causing the temperature of the water to be increased.

The control entity 80 is responsive to a signal indicative of the command to increase the temperature of the water originating from either button 88 or 89, for causing the desired change in the water temperature to be implemented.

Although the present specification has described embodiments of the invention having a control panel with two portions, it will be appreciated that the control panel may be comprised of two or more portions for facilitating usage thereof from multiple locations.

Although various embodiments have been illustrated, this was for the purpose of describing, but not limiting, the invention. Various modifications will become apparent to those skilled in the art and are within the scope of this invention, which is defined more particularly by the attached claims.

What is claimed is:

1. A control panel suitable for use in controlling operational settings of a spa, said control panel comprising:

a first portion having a first user input device for enabling a user to enter a signal indicative of a desired change in a certain operational setting of the spa; and a second portion joined to said first portion, said second portion having a second user input device for enabling a user to enter a signal indicative of a desired change in the same certain operational setting of the spa as said first user input device;

said first user input device being included within a first user interface that is adapted for being positioned such as to facilitate use by a user situated in a first location, and said second user input device being included within a second user interface that is adapted for being positioned such as to facilitate use by a user situated in a second location.

2. A control panel as defined in claim 1, wherein the first location is located within the spa, and the second location is located outside the spa.

3. A control panel as defined in claim 1, wherein said first portion is adapted to be positioned along an inner wall of the spa and said second portion is adapted to be positioned along a rim wall of the spa.

4. A control panel as defined in claim 3, wherein said first portion is adapted to be positioned along an inner wall such as to be recessed from the inner wall.

5. A control panel as defined in claim 3, wherein said first portion is adapted to be positioned along an inner wall such as to protrude from the inner wall.

6. A control panel as defined in claim 3, wherein said first portion is adapted to be positioned along an inner wall such as to be positioned at an angle with respect to the inner wall.

7. A control panel as defined in claim 3, wherein said second portion is adapted to be positioned along a rim wall such as to be recessed from the rim wall.

8. A control panel as defined in claim 3, wherein said second portion is adapted to be positioned along a rim wall such as to protrude from the rim wall.

9. A control panel as defined in claim 3, wherein said first portion is adapted to be positioned along a rim wall such as to be positioned at an angle with respect to the rim wall.

10. A control panel as defined in claim 1, wherein said first portion is adapted to be positioned along a rim wall of the spa, and said second portion is adapted to be positioned along an outside wall of the spa.

11. A control panel as defined in claim 1, wherein said first portion and said second portion are joined via a third portion.

12. A control panel as defined in claim 11, wherein said first portion is adapted to be positioned along an inner wall of the spa and said second portion is adapted to be positioned along an outer wall of the spa.

13. A control panel as defined in claim 1, wherein said first portion and said second portion are joined together to form an angle.

14. A control panel as defined in claim 13, wherein said angle is an obtuse angle.

15. A control panel as defined in claim 13, wherein said angle is an acute angle.

16. A control panel as defined in claim 13, wherein said angle is between about 45 degrees and about 170 degrees.

17. A control panel as defined in claim 1, wherein said first user interface and said second user interface include multiple user input devices for enabling a user to control multiple operational settings of the spa.

18. A control panel as defined in claim 17, wherein:

said first user interface includes a first set of user input devices adapted for enabling a user to control a set of operational settings of the spa; and said second user interface includes a second set of user input devices adapted for enabling a user to control the same set of operational settings of the spa as said first set of user input devices such as to allow a user to cause desired changes in the same set of operational settings of the spa at said first user interface and at said second user interface.

19. A control panel as defined in claim 18, wherein:

said first user interface includes a first set of user input devices adapted for enabling a user to control a first set of operational settings;

said second user interface includes a second set of user input devices adapted for enabling a user to control a second set of operational settings, said second set of operational settings including at least one operational setting absent from said first set of operational settings such as to allow a user to cause desired changes in different sets of operational settings of the spa at said first user interface and at said second user interface.

20. A control panel as defined in claim 1, wherein said second user interface includes a display screen and a keypad.

21. A control panel as defined in claim 20, wherein said first user interface includes a keypad.

22. A control panel as defined in claim 21, wherein said first user interface includes a display screen.

23. A control panel as defined in claim 1, wherein said second user interface includes a keypad and said first user interface includes a display screen.

24. A control panel as defined in claim 23, wherein said first user interface further includes a keypad.

25. A control system suitable for controlling operational settings of a spa, said control system comprising:

a first portion having a first user input device for enabling a user to enter a signal indicative of a desired change in a certain operational setting of the spa; and a second portion joined to said first portion, said second portion having a second user input device for enabling a user to enter a signal indicative of a desired change in the same certain operational setting of the spa as said first user input device;

a control entity in communication with said first user input device and said second user input device for receiving signals indicative of desired changes in the certain operational setting of the spa, said control entity being responsive to a signal received from either one of said first user input device and said second user input device indicative of a desired change in the certain operational setting of the spa for causing the desired change in the certain operational setting of the spa to be implemented.

26. A control system as defined in claim 25, wherein said control entity is in wire-line communication with said first user input device and said second user input device.

27. A control system as defined in claim 25, wherein said control entity is in wireless communication with either one of said first user input device and said second user input device.

28. A control system as defined in claim 25, wherein:

said first portion includes a first user interface, said first user input device being part of said first user interface;

said second portion includes a second user interface, said second user input device being part of second user interface;

said first user interface being adapted to be positioned such as to facilitate use by a user situated within the spa;

said second user interface being adapted to be positioned such as to facilitate use by a user situated outside the spa.

29. A control system as defined in claim 28, wherein said first portion is adapted to be positioned along an inner wall of the spa and said second portion is adapted to be positioned along a rim wall of the spa.

30. A control system as defined in claim 28, wherein said first portion is adapted to be positioned along a rim wall of the spa, and said second portion is adapted to be positioned along an outside wall of the spa.

31. A control system as defined in claim 28, wherein said first portion and said second portion are joined via a third portion.

32. A control system as defined in claim 31, wherein said first portion is adapted to be positioned along an inner wall of the spa and said second portion is adapted to be positioned along an outer wall of the spa.

33. A control system as defined in claim 28, wherein said first user interface and said second user interface include multiple user input devices for enabling a user to control multiple operational settings of the spa.

34. A control system as defined in claim 33, wherein:

said first user interface includes a first set of user input devices adapted for enabling a user to control a set of operational settings of the spa;

said second user interface includes a second set of user input devices adapted for enabling a user to control the same set of operational settings of the spa as said first set of user input devices such as to allow a user to cause desired changes in the same set of operational settings of the spa at said first user interface and at said second user interface.

35. A control system as defined in claim 33, wherein:

said first user interface includes a first set of user input devices adapted for enabling a user to control a first set of operational settings;

said second user interface includes a second set of user input devices adapted for enabling a user to control a second set of operational settings, said second set of operational settings including at least one operational setting absent from said first set of operational settings such as to allow a user to cause desired changes in different sets of operational settings of the spa at said first user interface and at said second user interface.

36. A control system as defined in claim 33, wherein:

said first user interface includes a first set of user input devices adapted for enabling a user to control a first set of operational settings;

said second user interface includes a second set of user input devices adapted for enabling a user to control a second set of operational settings, said second set of operational settings excluding at least one operational setting present in said first set of operational settings such as to allow a user to cause desired changes in different sets of operational settings of the spa at said first user interface and at said second user interface.

37. A control system as defined in claim 25, wherein said first portion and said second portion are joined together to form an angle.

38. A control system as defined in claim 37, wherein said angle is an obtuse angle.

39. A control system as defined in claim 37, wherein said angle is an acute angle.

40. A control system as defined in claim 37, wherein said angle is between about 45 degrees and about 170 degrees.

41. A spa system comprising:

a) a spa shell;

b) a comfort component;

c) a control system mounted to said spa shell, said control system being adapted for causing the generation of signals directed to said comfort component for controlling an operational setting of the spa, said control system including:

i) a control panel having:

1) a first portion having a first user input device for enabling a user to enter a signal indicative of a desired change in the operational setting of the spa; and 2) a second portion joined to said first portion, said second portion having a second user input device for enabling a user to enter a signal indicative of a desired change in the same operational setting of the spa as the first user input device;

ii) a control entity in communication with said first user input device and said second user input device for receiving signals indicative of desired changes in the operational setting of the spa, said control entity being responsive to a signal received from either one of said first user input device and said second user input device indicative of a desired change in the operational setting of the spa for causing the desired change in the operational setting of the spa to be implemented.

42. A spa system as defined in claim 41, wherein said comfort component is selected from the set consisting of a heating element, a pump, a blower, a valve, an ozonator, a sanitization system, a lighting element, audio equipment video equipment and computer equipment.

43. A spa system as defined in claim 41, wherein said spa shell includes:

a) a rim wall;

b) an outside wall; and c) an inner wall connected to said outside wall by said rim wall;

the first portion of said control panel being adapted to be positioned along the inner wall of the spa shell; and the second portion of said control panel being adapted to be positioned along the rim wall of the spa shell.

44. A spa system as defined in claim 41, wherein said spa shell includes:

a) a rim wall;

b) an outside wall; and c) an inner wall connected to said outside wall by said rim wall;

the first portion of said control panel being adapted to be positioned along the rim wall of the spa shell; and the second portion of said control panel being adapted to be positioned along the outside wall of the spa shell.

45. A spa system as defined in claim 41, wherein said first portion and said second portion of said control panel are joined via a third portion.

46. A spa system as defined in claim 41, wherein said spa shell includes:

a) a rim wall;

b) an outside wall; and c) an inner wall connected to said outside wall by said rim wall;

the first portion of said control panel being adapted to be positioned along the inner wall of the spa shell; and the second portion of said control panel being adapted to be positioned along the outer wall of the spa shell.

47. A spa system as defined in claim 41, wherein said first portion and said second portion of said control panel are joined together to form an angle.

48. A spa system as defined in claim 47, wherein said spa shell includes:

a) a rim wall;

b) an outside wall; and c) an inner wall connected to said outside wall by said rim wall;

control panel being adapted to be positioned substantially atop said rim wall.

49. A control panel suitable for controlling operational settings of a spa, said control panel comprising:

a first portion having a first user interface including a first user input device for enabling a user to enter a signal indicative of a desired change in a certain operational setting of the spa; and a second portion joined to said first portion, said second portion having a second user interface for conveying information related to the certain operational setting of the spa;

said first portion and said second portion being joined together to form an angle such that said first user interface is positioned to facilitate use by a user situated in a first location, and said second user interface is positioned such as to facilitate use by a user situated in a second location.

50. A control panel as defined in claim 49, wherein said second user interface includes a display screen for displaying information indicative of the certain operational setting of the spa.

51. A control panel as defined in claim 49, wherein said second user interface includes a audio output device for issuing an audio signal conveying the certain operational setting of the spa.

52. A control panel as defined in claim 49, wherein said second user interface includes a second user input device for enabling a user to enter a signal indicative of a desired change in the certain operational setting of the spa.

53. A control panel as defined in claim 49, wherein said first user interface is adapted for conveying information indicative of the certain operational setting of the spa.

54. A control panel as defined in claim 53, wherein said first user interface includes a display screen for displaying information indicative of the certain operational setting of the spa.

55. A control panel as defined in claim 49, wherein said first portion is adapted to be positioned along an inner wall of the spa and said second portion is adapted to be positioned along a rim wall of the spa.

56. A control panel as defined in claim 49, wherein said first portion is adapted to be positioned along a rim wall of the spa, and said second portion is adapted to be positioned along an outside wall of the spa.

57. A control panel as defined in claim 49, wherein said first portion and said second portion are joined via a third portion.

58. A control panel as defined in claim 57, wherein said first portion is adapted to be positioned along an inner wall of the spa and said second portion is adapted to be positioned along an outer wall of the spa.

59. A control panel as defined in claim 49, wherein either one of the first location or second location is located within the spa, and the other one of the first location or second location is located outside the spa.

60. A control panel suitable for controlling an operational setting of a spa, said control panel comprising:

a first portion having first means for enabling a user to enter a signal indicative of a desired change in the operational setting of the spa; and a second portion joined to said first portion such as to form an angle therebetween, said second portion having second means for enabling a user to enter a signal indicative of a desired change in a second operational setting of the spa;

said first means being adapted for being positioned such as to facilitate use by a user situated in a first location, and said second means being adapted for being positioned such as to facilitate use by a user situated in a second location.

* * * * *